US007246929B2

(12) United States Patent
Schuster

(10) Patent No.: US 7,246,929 B2
(45) Date of Patent: Jul. 24, 2007

(54) LANDSCAPE LIGHTPOST WITH RECEPTACLE CAVITY

(75) Inventor: Jack Schuster, Mound, MN (US)

(73) Assignee: Engineered Products Co., Minneapolis, MN (US)

( * ) Notice: Subject to any disclaimer, the term of this patent is extended or adjusted under 35 U.S.C. 154(b) by 65 days.

(21) Appl. No.: 11/288,556

(22) Filed: Nov. 29, 2005

(65) Prior Publication Data

US 2006/0114682 A1 Jun. 1, 2006

Related U.S. Application Data

(60) Provisional application No. 60/632,121, filed on Dec. 1, 2004.

(51) Int. Cl.
*F21V 8/00* (2006.01)

(52) U.S. Cl. ..... 362/431; 362/152

(58) Field of Classification Search ..... 362/153, 362/431, 267, 152, 153.1, 645
See application file for complete search history.

(56) References Cited

U.S. PATENT DOCUMENTS

| | | | | |
|---|---|---|---|---|
| 3,691,288 | A | 9/1972 | Sturdivan | |
| 4,858,877 | A | 8/1989 | Carter | |
| 4,996,636 | A * | 2/1991 | Lovett | 362/431 |
| 5,398,180 | A * | 3/1995 | Lee | 362/431 |
| 5,429,112 | A * | 7/1995 | Rozzi | 126/116 A |
| D365,166 | S | 12/1995 | Harris et al. | |
| 5,521,595 | A * | 5/1996 | Totten et al. | 340/908 |
| 5,527,993 | A | 6/1996 | Shotey et al. | |
| 5,586,742 | A | 12/1996 | Carter | |
| 5,820,255 | A | 10/1998 | Carrington et al. | |
| D424,524 | S | 5/2000 | Guercio | |
| D430,792 | S | 9/2000 | Wang | |
| D430,942 | S | 9/2000 | Schuster | |
| 6,303,863 | B1 | 10/2001 | Raasch | |
| 6,585,211 | B1 | 7/2003 | Harris et al. | |
| 6,667,437 | B2 | 12/2003 | Schenk | |
| 6,752,362 | B1 | 6/2004 | Gretz | |
| 6,863,251 | B1 * | 3/2005 | Gretz | 248/156 |
| 6,874,905 | B1 * | 4/2005 | Beadle | 362/153.1 |
| 6,877,886 | B2 | 4/2005 | Schuster et al. | |
| 6,915,992 | B1 | 7/2005 | Gretz | |

* cited by examiner

*Primary Examiner*—Thomas M. Sember
*Assistant Examiner*—Julie A. Shallenberger
(74) *Attorney, Agent, or Firm*—Patterson, Thuente, Skaar & Christensen, P.A.

(57) ABSTRACT

A landscape lightpost that provides a substantially sealed wire compartment. The lightpost includes a main post, a cap, a housing base, and a housing separator. The housing separator locks onto the housing base to form a locked wire compartment isolated from the ground. The lightpost includes a receptacle aperture in the cap for mounting an electrical receptacle, switch, sensor or the like and a light aperture for mounting a light assembly. The receptacle aperture is covered by a sealable lid that matches the external configuration of the cap.

30 Claims, 7 Drawing Sheets

SECTION A-A

FIGURE 8
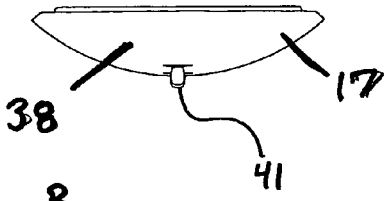
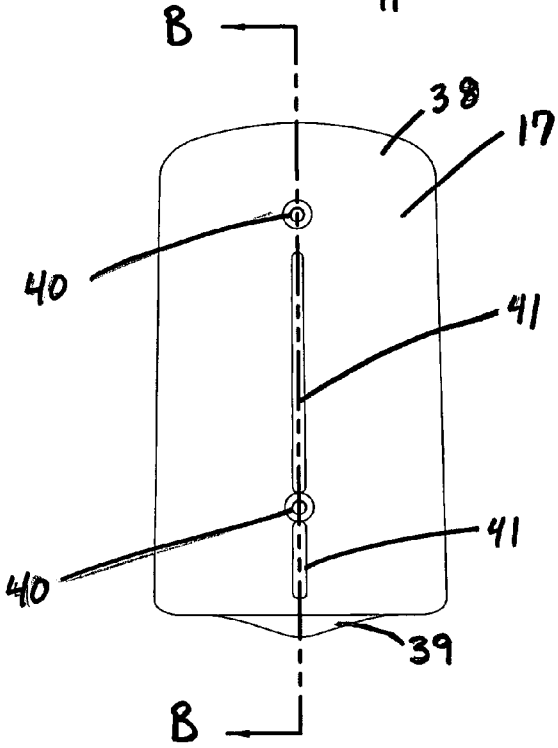
FIGURE 9
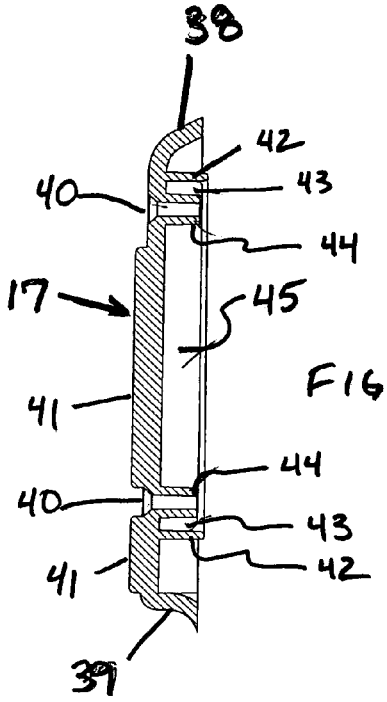
FIGURE 11
SECTION B-B
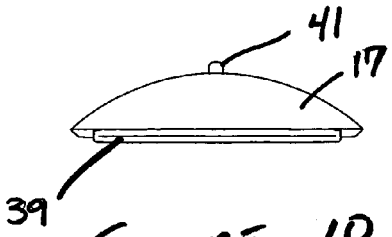
FIGURE 10

SECTION C–C

LANDSCAPE LIGHTPOST WITH RECEPTACLE CAVITY

RELATED APPLICATION

The present application claims the benefit of U.S. Provisional Application No. 60/632,121 filed Dec. 1, 2004, which is incorporated herein in its entirety by reference.

FIELD OF THE INVENTION

The present invention relates generally to architectural landscape products. More, particularly, the present invention relates to a landscape lightpost that includes a substantially enclosed and sealed wire compartment for protecting an electrical receptacle, outlet, switch, telephone or cable plate, or similar device.

BACKGROUND OF THE INVENTION

In many landscaping projects, it is desirable to provide lighting for either safety or aesthetic concerns. One particularly popular way of providing lighting is through a series of lights that are mounted above a ground surface adjacent to a walkway or drive way. These types of lights are typically mounted to a post that is partially buried in a ground surface. The post thereby provides a stable support for the lights. The post also provides a means to discretely feed buried wires used to power the lights into the light fixture. It is also desirable to provide discrete access to telephone, cable or electrical sources within a landscaping project for user enjoyment or to provide power for landscaping tools such as blowers, trimmers and the like.

There are some prior art examples that attempt to satisfy this need. U.S. Pat. Nos. 4,858,877 and 5,586,742 each disclose a lightpost for supporting a light fixture that includes a main post, a cap and a mounting structure. Another design for a landscape lightpost is set forth in Schuster, U.S. Pat. No. D430,942, which is assigned the assignee of the present application. The Schuster landscape lightpost includes a main post, a cap and a fin assembly. Arlington Industries, Inc of Scranton, Pa., markets a landscape lightpost having a substantially square profile to the main post and cap. The Arlington landscape lightpost has an aperture in one side thereof that provides access to a region where electrical connections are made. A cover plate is attached to the lightpost to cover the aperture and thereby restrict access to the area where the electrical connections are made.

However, none of the prior art landscape lightpost designs provides a cylindrical post with a substantially enclosed and sealed wire compartment, which protects the wire connections from exposure to the environmental elements, provides a means for securely connecting a wire or cabling system and provides easy access to the wire connections.

SUMMARY OF THE INVENTION

The present invention is a landscape lightpost for supporting a light fixture at a desired location above ground surface. The landscape lightpost generally includes a main post with stabilizer fins, a cap resting on a housing base, and a lockable separator plate that engages the housing base. The separator plate is designed for placement over an end of the main post. The cap has a recess formed therein. The recess is adapted to receive the end of the main post over which the separator plate is placed. The present invention incorporates by reference U.S. Pat. No. 6,877,886, also assigned to the assignee of the current invention with common inventor, for a landscape lightpost which describes a non-locking non-sealed cavity.

Attaching the cap to the housing base with a locked separator dividing the main post cavity from the cap cavity defines a substantially enclosed region where connections between the light fixture and a feed wire are made. Further, because the cap incorporates a self-sealing housing cover, the installer has the flexibility to install a landscape fixture alone without compromising appearances. With the cover in-place as it is received from the factory, the electrician/installer simply wires the fixture to the Post/Cap.

To comply with both NEC Codes and UL Standards, for use with a wiring device such as a receptacle, the cap must not rely on the earth or ground to form the bottom of the junction box. UL standards also require that the bottom of the cap be sealed or enclosed even in the event the cap were to be removed from the main post. The present invention includes a housing separator that encloses the bottom of the cap. It can accept at least two independent cable connectors. Moreover, the present invention incorporates a bayonet mount for a self-locking feature.

In addition, UL requires that cables/connectors installed in the knock-out be subject to hold 300 pounds without any visible damage to the knock-out(s), the space surrounding the knock-out(s), as well as the entire structure of the cap that forms the junction box. The present invention includes a novel structure of separator/housing base that distributes the load required by the UL standard. In addition, the knock-outs(s) are disposed within a separator plate positioned to distribute the load without deforming the housing cap structure or the separator itself.

The present invention also includes a design to improve the efficiency and flexibility of installation. The intent of having the separator removable instead of pre-molded to the cap makes it easier for the electrician to install the cable and connectors with lock nuts to the cap. Once the cable with connectors assembly has been installed into the knock-outs on the separator, the electrician would attach the separator feeding his cables into the cap, push the separator into the cap, and rotate the separator ¼". The cap/separator has a self-locking mechanism after the ¼" rotation which prevents the separator from being removed. Thus the entire installation process avoids the need for fasteners in joining the separator to the cap.

BRIEF DESCRIPTION OF THE DRAWINGS

FIG. 8 is a top planar view of the housing cover;

FIG. 9 is an exterior planar view of the housing cover;

FIG. 10 is a bottom planar view of the housing cover;

FIG. 11 is a cross-sectional view of the housing cover taken along section B-B of FIG. 9;

DETAILED DESCRIPTION OF THE PREFERRED EMBODIMENTS

Figure 1:
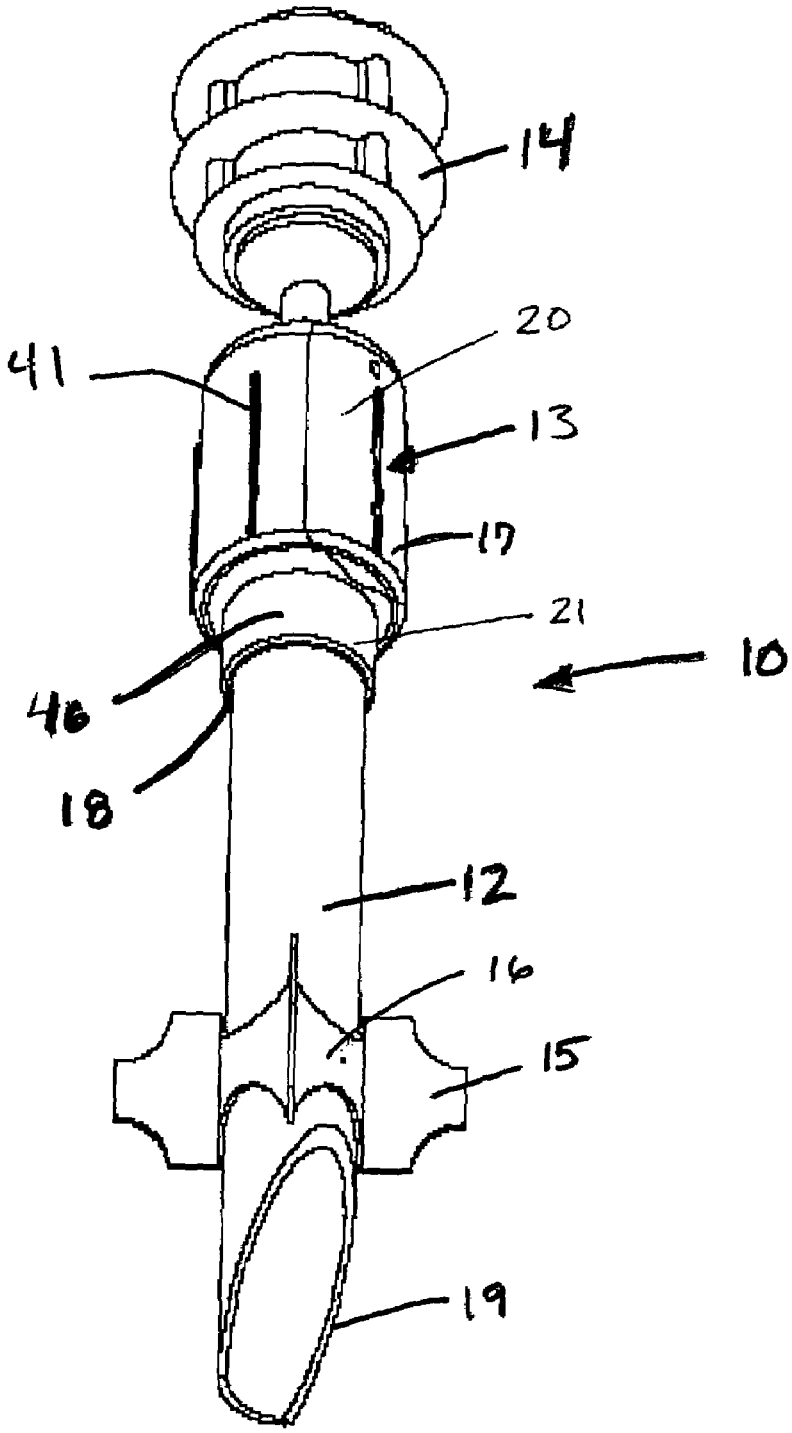
FIG. 1 is a perspective view of a landscape lightpost according to the present invention.

A landscape lightpost 10 in accordance with the present invention is illustrated in FIG. 1. The landscape lightpost 10 generally includes a main post 12, a housing 13, and a light assembly 14. When assembled, the landscape lightpost 10 provides a substantially sealed region within housing 13 where electrical connections are made to thereby protect the electrical connections from exposure to environmental elements.

In the first embodiment, the main post 12 is a substantially cylindrical tube. The main post 12 can be fabricated from polyvinyl chloride and preferably has a length of about nineteen inches and an outer diameter of about three inches. However, a person of ordinary skill in the art will appreciate that main post 12 may be fabricated with alternate shapes, materials and sizes using the concepts of the present invention. The main post 12 has an upper end 18 and a lower end 19. The upper end 18 presents structure defining an operably oriented face substantially perpendicular to the main longitudinal axis of the main post 12. The lower end 19 is preferably angled to facilitate inserting the main post 12 into a ground surface (not shown). The angle of the lower end 19 is less than forty-five degrees, preferably less than twenty-five degrees and most preferably between fifteen and twenty degrees. Orienting the lower end 19 at an angle also facilitates feeding wires into the main post 12 and for wiring multiple lighting fixtures in series because the angled bottom allows cable or conduit to easily enter at different depths thereby avoiding wire congestion.

At the base of landscape lightpost 10 is a plurality of fins 15 extending perpendicular to main post 12 so as to prevent rotation and yaw of light assembly 14. Fins 15 are attached to fin collar 16 that encircles the main post 12 proximate to the lower end 19. One example of this assembly is illustrated in Schuster U.S. Pat. No. D430, 942 and incorporated herein by reference. The plurality of fins 15 includes at least one, and preferably four, fins that extend outwardly from the main post 12. A preferred shape of the fins is illustrated in FIG. 1. The concave stabilizing design enables ground material to be easily packed around the landscape lightpost 10 and provides solidly anchored, in-ground support. This concave design also helps resist against heaving caused by ground freezing and thawing.

Housing 13 is disposed at the upper end 18 of main post 12 operably connected through housing base 16. Housing 13 includes on one external aspect a removable housing cover 17. Housing cover 17 is cylindrical segment removed from housing 13 so that when attached, housing cover 17 completes the symmetrical external shape of housing 13. Housing cover 17 has a planar area sized for covering an electrical receptacle or switch that can be disposed within housing 17.

Figures 2, 3:
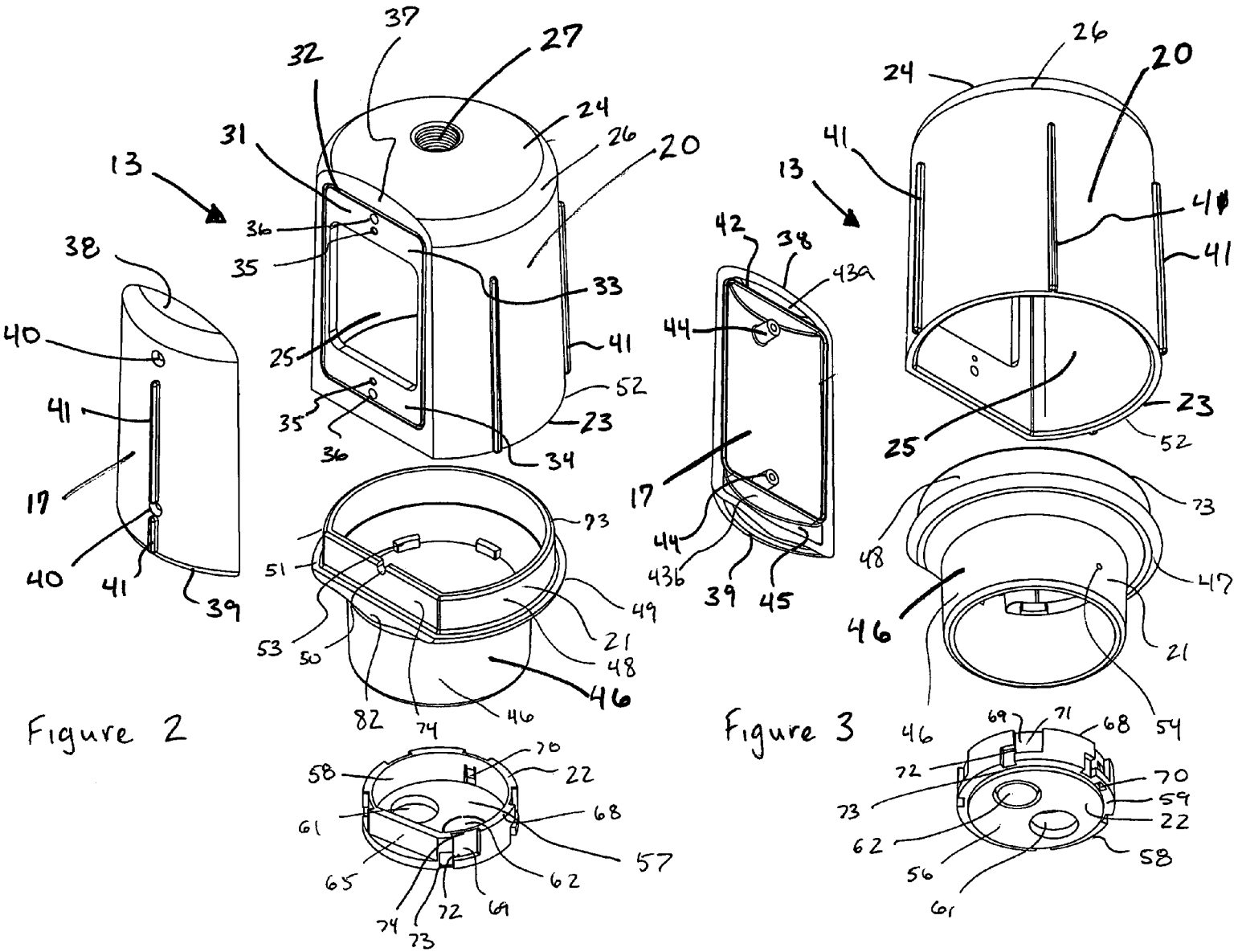
FIG. 2 is a component perspective view of the landscape lightpost housing and support structure.
FIG. 3 is an opposing component perspective view of the landscape lightpost housing and support structure.

As illustrated in FIGS. 2-3, the housing 13 includes the housing cap 20, the housing base 21, the housing separator 22, and the housing cover 17. The housing cap 20 has an open end 23 and a substantially closed end 24. The open end 23 provides access to a cavity 25 formed therein. The housing cap 20 can preferably be made in two material versions: fabricated out of polyvinyl chloride and fabricated out of zinc die case steel or other metallic material. The material choice takes into consideration the expected product environment. Specifically, the landscape lightpost 10 is shatter resistant to denting or cracking typically caused by contact with landscape maintenance equipment. It is also corrosion and UV (ultraviolet) resistant and impervious to changing environmental conditions such as the extreme heat of the Southwestern summers or the brutal cold of Northeastern winters.

Figure 6:
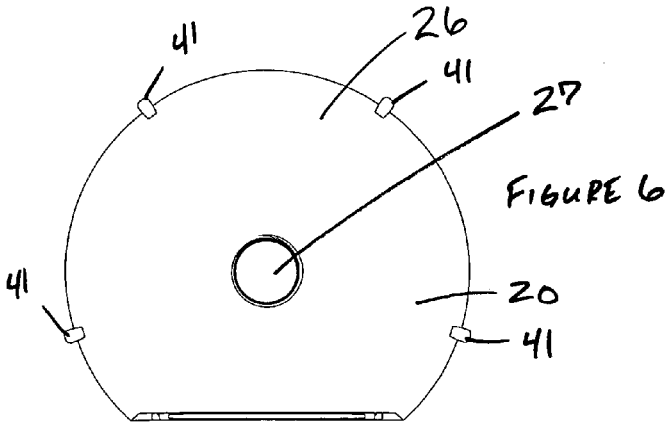
FIG. 6 is a top plan view of the exterior of the housing cap with the housing cover removed.
Figure 4:
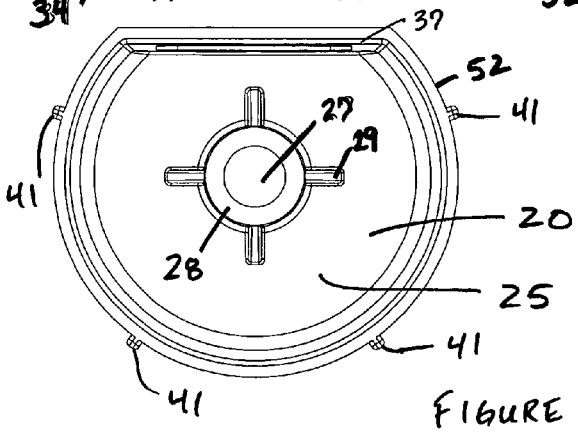
FIG. 4 is a bottom plan view of the interior of the housing cap with the housing cover removed.

The closed end 24 of housing cap 20 preferably has a crown 26 that forms a curved or angled surface and reduces the likelihood that water or other substances will accumulate on the closed end 24. The crown 26 may be slanted for example, at twenty degrees, so as to virtually eliminate water pooling or leakage into the interior of the landscape lightpost 10. As illustrated in FIGS. 2, 4, 6 and 7, an aperture 27 is provided on the closed end 24 for attaching light assembly 14. FIG. 4 is a plan view of crown 26 from the open end 23 and FIG. 6 is a plan view of crown 26 from above. The aperture 27 is designed to receive a threaded nipple (not shown) that extends from a light assembly 14 to facilitate attaching the light assembly 14 to the housing cap 20. The threaded nipple is, for example, a ½" trade size conduit nipple. The aperture 27 may include a threaded boss 28, shown in FIG. 7.

Figure 7:
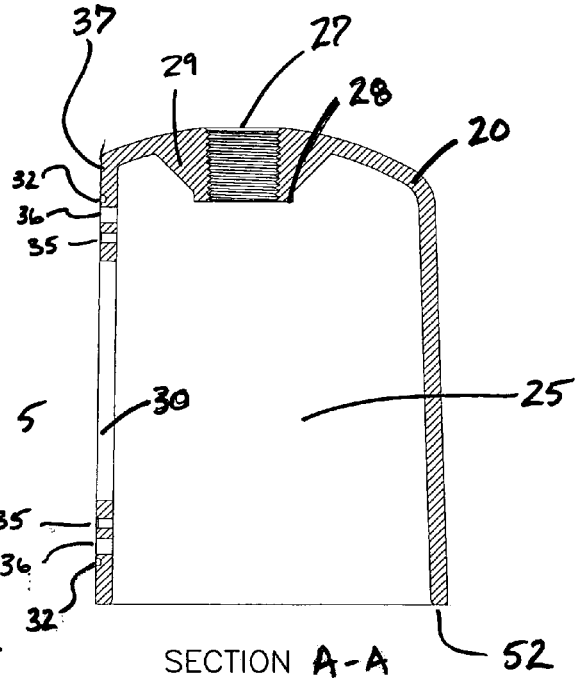
FIG. 7 is a sectional view of the housing cap without the housing cover taken along line A-A of FIG. 5.

As illustrated in FIGS. 4 and 7, aperture support ribs 29 extend radially from aperture 27 along interior face of crown 26. Aperture support ribs 29 flare out from threaded boss 28 to provide rigidity across crown 26 in the area or aperture 27 as it is expected that insertion of light assembly 14 may create a torque about threaded boss 28. Threaded boss 28 has a cylindrical shape extending into housing cap 20 as depicted in FIG. 7. In a first embodiment four support ribs 29 extend approximately one-quarter to one-third of the radius of crown 26.

Figure 5:
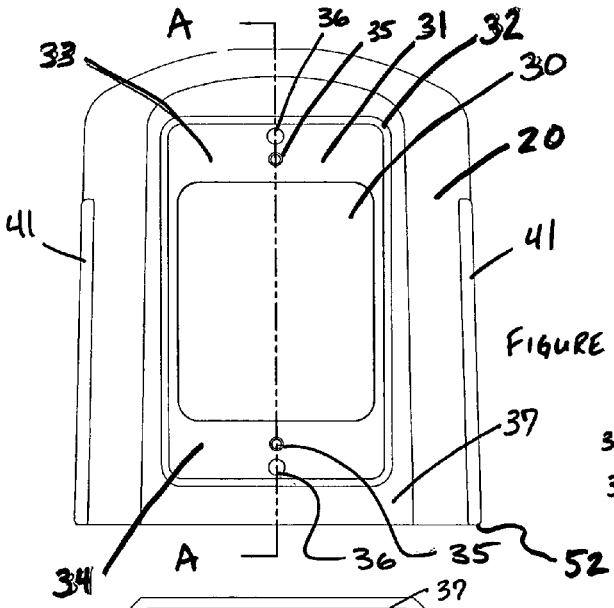
FIG. 5 is a side view of the housing cap of the present invention with the housing cover removed.

Housing cap 20 may also define one or more openings 30 on the side of housing cap 20 disposed between substantially closed end 24 and open end 23 as shown, for example in FIGS. 2, and 5-7. Opening 30 has a generally rectangular shape with radiused corners but other shapes are envisioned as required for the application (i.e., switch, sensor, receptacle, etc.). As illustrated in FIG. 2, opening 30 is defined by surrounding access frame 31. Access frame 31 is a planar face that extends from opening 30 to sealing groove 32. As depicted in FIGS. 2 and 5, sealing groove 32 is trenched with a nominal depth so as not to substantially weaken the structural integrity of the housing cap 20. In a first embodiment, sealing groove 32 is 0.060 inches deep while nominal wall thickness of housing cap 20 is 0.188 inches. Sealing groove 32 has a generally rectangular shape with radiused corners but may be sized according to the opening 30 and face plate 17. Sealing groove 32 provides a mating receptacle around opening 30 for face plate 17. Access frame 31 provides space for the mounting of an electrical switch or outlet within the area defined by sealing groove 32. Accordingly, access frame 31 includes upper receptacle mounting areas 33 and lower receptacle mounting area 34 for attachment of the receptacle flanges (See FIG. 12) Upper receptacle mounting area 33 and lower receptacle mounting area 34 contain lid screw aperture 35 and receptacle screw aperture 36.

FIG. 7 is a cross-sectional illustration of housing cap 20 along vertical section line A-A depicting in a first embodiment the structure along lid face 37. As indicated by FIG. 7, symmetrically positioned about opening 30 are lid screw aperture 35, receptacle aperture 36 and sealing groove 32. As shown in FIGS. 4-7, lid face 37 is defined by a generally planar cut through housing cap 20 from cap closed end 23 to cap open end 24. Therefore, lid face 37 is crowned relative to cap closed end 23 as it intersects crown 26. Lid face 37 extends beyond sealing groove 32 until intersecting the inherent curvature of cylindrical housing cap 20.

In a first embodiment of the present invention, the perimeter of lid face 37 mates with housing cover 17, as depicted in FIG. 2. As illustrated in FIGS. 8-11, housing cover 17 is generally a planar slice of housing cap 20. As depicted in end views FIGS. 8 and 10, housing cover 17 generally forms a circular segment corresponding to the radius of housing cap 20. Housing cover 17 includes an upper crown portion 38 that corresponds to the curvature of crown 26, and a base portion 39 which mates with housing base 21. Screw apertures 40 extend through housing cover 17 for fastening housing cover 17 to housing cap 20. Housing cap 20 and housing cover 17 include vertical support ribs 41 that are equally spaced about the circumference of housing 13. In this first embodiment, support rib 41 is interrupted by the placement of screw aperture 40. Screw apertures 40, as depicted in the first embodiment are countersunk for flush placement of screws (not shown).

FIG. 11 is a cross-sectional view of housing cover 17 along line B-B. Interior cover face 45 has a radiused cup shape so that the perimeter matches the perimeter of cap face cover 37. In particular, upper crown portion 38 corresponds to the curvature of crown 26, and a base portion 39 corresponds to the exterior of housing base 16. Interior cover face 45 includes sealing flange 42 that extends distally from housing cover 17 to engage sealing groove 32 of housing cap 20. Screw apertures 40 are defined by screw boss 44. Interior cover face 45 defines a void between opposing screw bosses 44 so that insertion of a receptacle does not interfere with mating housing cover 17 onto housing cap 20. Moreover, interior cover face 45 defines an area opposing the receptacle screw aperture 36 on housing cap 20 so that the head of a receptacle screw does not interfere with mating housing cover 17 onto housing cap 20. Sealing flange 42 does not extend all of the way to crown portion 38 or to base portion 39 of cover 17 leaving interior lid slots 43*a* and 43*b*.

The bottom edge of housing cap 20 rests on housing base 21 as depicted in FIGS. 2-3. Referring to FIGS. 12-15, housing base 21 flares about main post 12 to create a support for housing cap 20 and a mating face for the base portion 39 of housing cap 17. Housing base 21 includes main post collar 46 that transitions to flared collar 47, and interior guide ring 48. Main post collar 46 forms a ring about the upper end 18 of main post 12. Main post collar 46 has a cross-section slightly larger than the cross section of the main post 12 and a nominal thickness of 0.188 inches. In this first embodiment, both the main post 12 and the main post collar 46 are circular but other cross sectional shapes are envisioned. As main post collar 46 transitions to flared collar 47, the outer diameter of housing base 21 flares outboard to form perpendicular flange 49. The cross-sectional area of housing base 21 also transitions from a circle in main post collar 46 to a larger diameter circle with a circular segment removed for flared collar 47. The outer perimeter shape of the flared collar 47, as denoted by the perpendicular flange 49 corresponds to the interior perimeter shape of the lower edge 52 of housing cap 20. Housing cap 20 is disposed on perpendicular flange 49.

Figure 12:
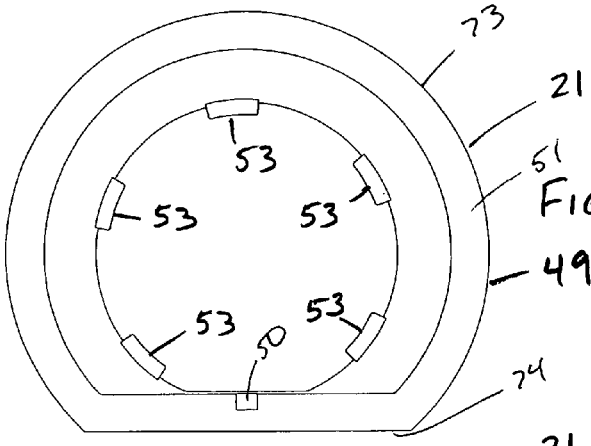
FIG. 12 is top planar view of the housing base.
Figure 14:
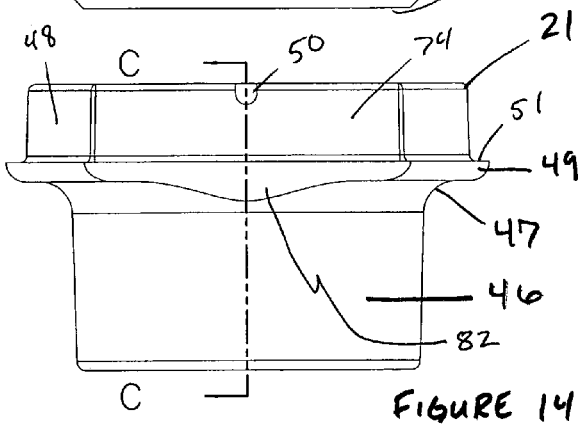
FIG. 14 is side planar view of the housing base.
Figure 15:
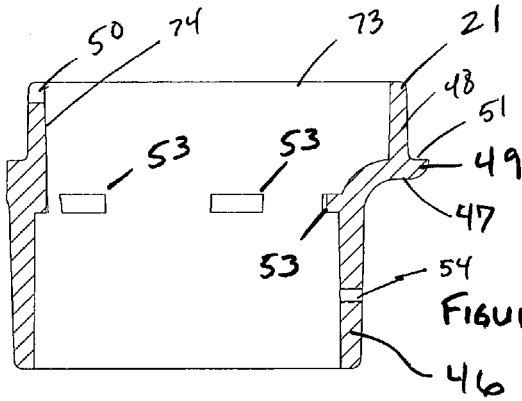
FIG. 15 is a cross-sectional view of the housing base along section C-C of FIG. 14.
Figure 13:
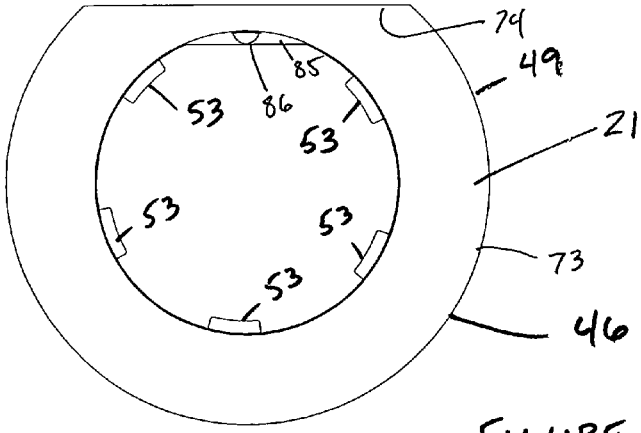
FIG. 13 is bottom planar view of the housing base.
Figure 16:
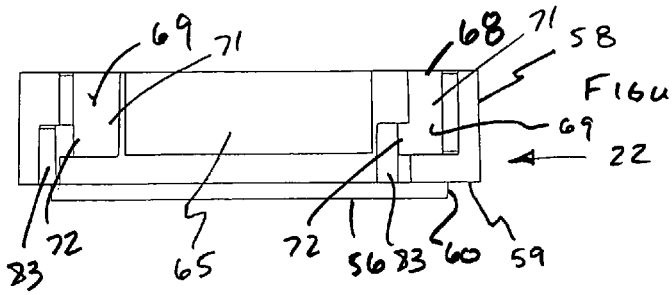
FIG. 16 is a side planar view of the housing separator.
Figure 17:
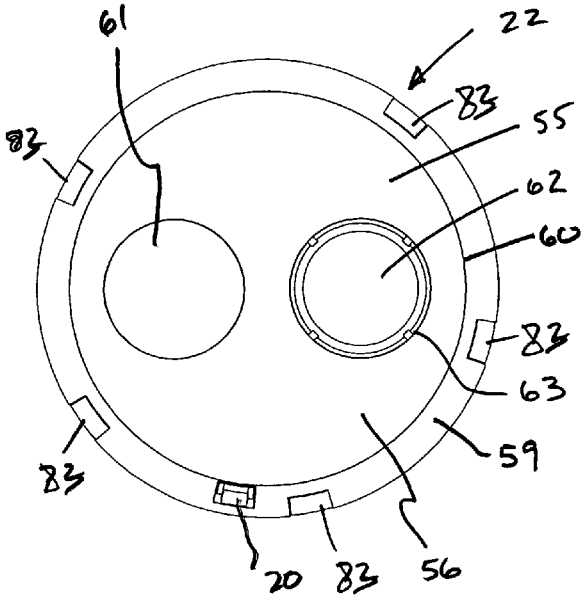
FIG. 17 is a bottom planar view of the housing separator.
Figure 18:
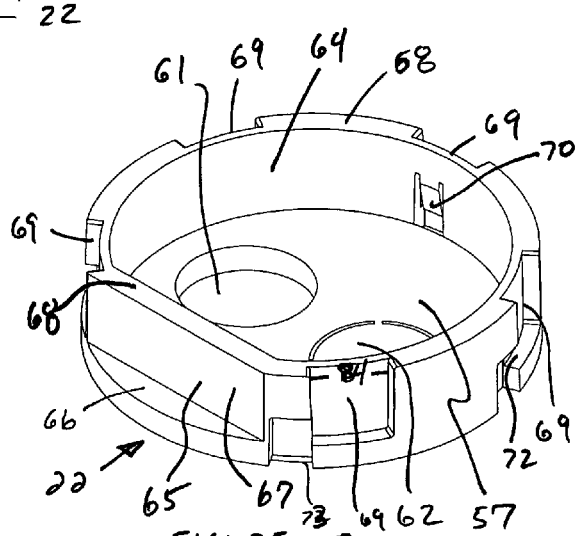
FIG. 18 is a top perspective view of the housing separator.
Figure 19:
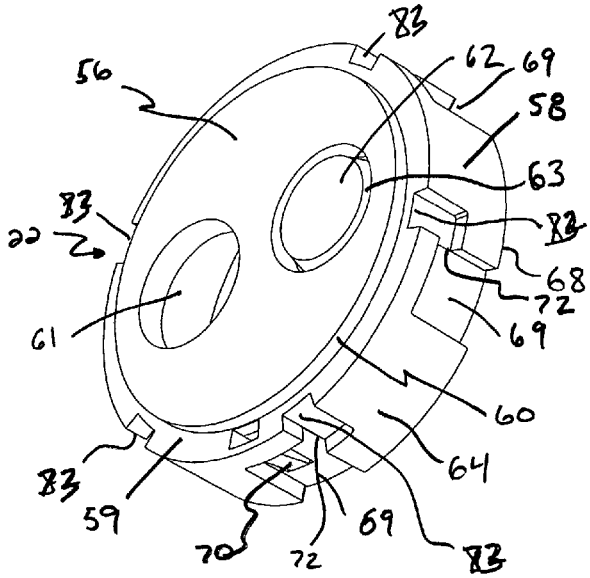
FIG. 19 is a bottom perspective view of the housing separator.

As illustrated in FIGS. 14 and 15, interior guide ring 48 extends vertically from perpendicular flange 48. Perpendicular flange 49 includes housing cap contact ring 51 that lies outbound of interior guide ring 48. Cap contact ring 51 provides an upward facing flat surface with a width equal to or greater than the width of lower edge 52 of housing cap 20. Perpendicular flange 49 also includes a lower lid engagement face 82 that abuts exterior face cover wall 37 which is covered by housing cover 17. Interior guide ring 48 extends vertically from perpendicular lip into cavity 25 of housing cap 20. The circumference of interior guide ring 48 is comprised of a radiused section 73 and a planar section 74. Radiused section 73 covers the majority of interior guide ring 48 while planar section 74 forms a tangential planar wall proximate the diameter of the main post collar, as depicted in FIG. 12. Planar section 74 includes a receptacle mounting slot 50 that is aligned with receptacle mounting aperture 36 of housing cap 20. The interior surface of housing base 21 includes a plurality of housing separator flanges 53 spaced equidistant about the interior diameter. Housing separator flanges 53 extend distally from housing base 21 to engage the housing separator 22. The interior surface also includes a separator ledge 85 disposed on ledge support 86 (See FIG. 13). Separator ledge 85 runs parallel to housing base planar section 74 across the upper end of main post collar 46. Ledge support 86 extend axially from separator ledge 85 within main post collar 46. Housing base 21 may also include one or more post fastener apertures 54 disposed through main post collar 46.

The housing separator 22 is sized to fit within the flared collar 47 of housing base 21. The housing separator 22 is thus provided with an outer profile that is preferably substantially the same as the main post 12, as illustrated in FIG. 1 as the upper end of the main post abuts the housing separator 22. The housing separator 22 similar to the housing 13 can preferably be made in two material versions: fabricated out of polyvinyl chloride and fabricated out of zinc die cast steel or other metallic material. The details of the first embodiment of the housing separator 22 are illustrated in FIGS. 16-19. The housing separator 22 includes a separator plate 55 having a lower plate surface 56 and an upper plate surface 57, the separator plate 55 attached to the interior of the separator ring 58. The lower surface 56 of separator plate 55 extends beyond the lower face 59 of the separator ring 22 thus defining the post engagement disk 60. The inner diameter of the upper end 18 of main post 12 is slightly less than the diameter of the post engagement disk 60. The post engagement disk 60 permits the housing separator 22 to partially seat in the main post 12 to retain the housing separator 22 in a stationary position with respect to the main post 12 when assembling the landscape lightpost 10.

The housing separator 22 includes at least one open aperture 61 adapted to receive a cable connector device. However, to accommodate multiple electrical circuits, or to allow an electrician to wire multiple light fixtures in series, the housing separator 22 includes two ½ inch diameter apertures: one aperture 61 that is manufactured open and another semi-closed aperture 62 that is manufactured closed, but with perforations 63 which enable the aperture 62 to be knocked out (opened) by the installer (the closure material commonly known as knockouts). The intended purpose of apertures 61 and 62 is to allow the installer to extend a cable connector device through the apertures. The housing separator 22 may include a 10/32-inch tapped hole to accommodate a grounding bond wire or 10/32-inch ground screw.

The housing separator 22, as illustrated in FIGS. 16-19, also includes elements necessary to lock the housing separator 22 to the housing base 21. The circumference of the separator ring 58 includes a locking portion 64 and a step portion 65. The step portion 65 is comprised of an arced flange 66 that supports the planar face 67. The arced flange 66 is a circular segment defined by the planar face 67 cutting across the upper section of the step portion 65 of the separator ring 58. The base of the arced flange 66 is defined by the lower face 59 for the lower face 57 maintains a constant radius. The planar face 67 extends axially from the upper face of the separator ring 68 to the arced flange 66. The planar face 67 lies perpendicular to the radius of separator ring 68 and extends radially between the ends of the locking portion 64. In a first embodiment, planar face 67 spans approximately sixty-nine degrees.

The locking portion 64 of housing separator 22 includes a plurality of locking slots 69 disposed equidistant about the perimeter of the locking portion 64. In a first embodiment, one of the locking slots 69 includes a single bayonet snap lock 70 that maintains the position of the housing separator 22 relative to the housing base 21. Each locking slot 69 includes an engagement aperture 71 positioned proximate the upper end 68 of separator ring 68, a transition slot 72 and a locked aperture 83 radially offset from engagement aperture 71. The transition slot 72 operably connects the engagement aperture 71 to the locked aperture 83. The locked apertures 83 open onto the lower face 59 of the separator ring 58. Therefore the combined axial depth of the locked apertures 83 and the engagement apertures 71 equal the axial length on the separator ring 58. Note that the locking slots 69 do not breech the inner diameter of the separator ring 58. In a first embodiment there are five locking slots 69 distributed evenly about the perimeter of the locking portion 64. The radial length 84 of engagement aperture 71 is slightly less than radial length of housing separator flanges 53 that extend distally from housing base 21 to engage the housing separator 22. The axial depth 75 of transition slot 72 is slightly greater than the axial depth the housing separator flanges 53. In a first embodiment one of the locking slots 69 includes a bayonet snap lock 70. The bayonet snap lock 70 is disposed within the engagement aperture 71 and includes a bayonet portion 76 and a cutout 77 disposed axially. The cutout 77 creates an opening through the separator ring 58. The bayonet portion 76 originates proximate the separator ring upper face 68 and then angles radially outboard. In a first embodiment, the angle is between ten and twenty degrees. The cutout 77 provides travel for the bayonet portion 76 as it is radially compressed. The installer must then apply axially force to overcome the bayonet portion 76 and then provide a radial force to direct the housing separator flanges 53 into the transition slot 72 so as to insert the housing separator 22 into the housing base 21.

Figure 21:
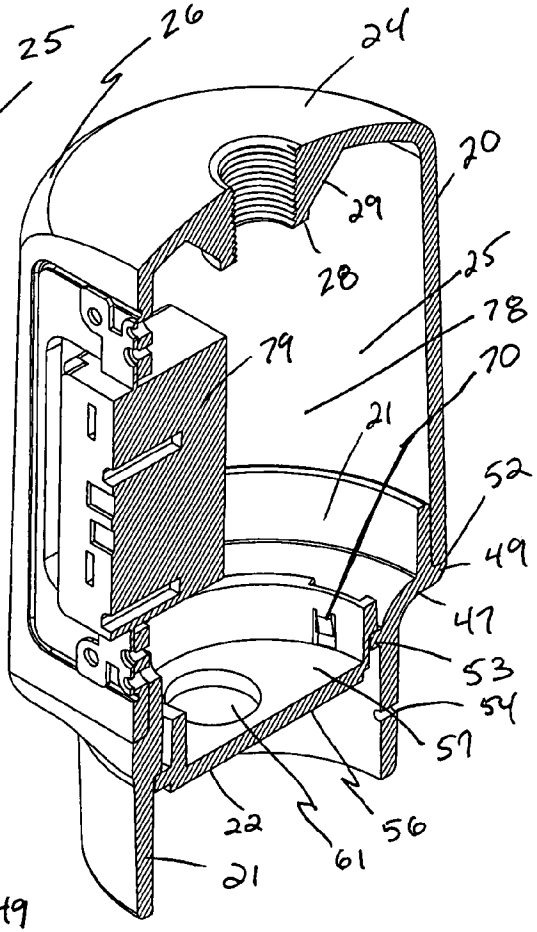
FIG. 21 is perspective cross sectional view of the housing with an electrical outlet installed.
Figure 20:
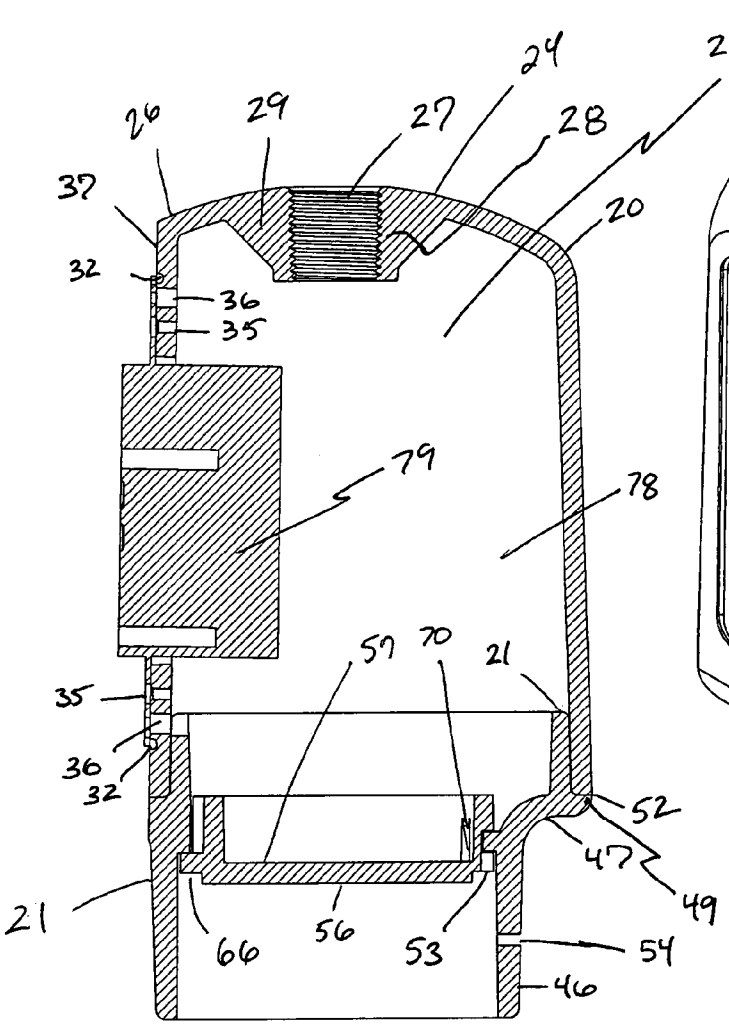
FIG. 20 is planar cross-sectional view of the housing with an electrical outlet installed.

The housing cap 13 and the housing separator 22 thereby define a substantially enclosed region 78, as illustrated in FIGS. 20-21. The size of the substantially enclosed region 78 is selected based upon the size and number of wires that must be connected in the substantially enclosed region 78. The substantially enclosed region 78 has a volume of greater than 5 cubic inches, preferably between 10 and 19 cubic inches and most preferably about 13½ cubic inches. The most preferred configuration is particularly suited where six 12 gauge wires must be connected within the substantially enclosed region 78.

As illustrated in FIGS. 20-21 the housing cap 13 may be designed to receive an electrical switch, an electrical outlet 79 (such as a GFCI outlet), an additional light fixture, a camera, a sensor (such as a photo sensor or a motion sensor), an audio speaker or the like. FIGS. 20-21 show exemplary views of the installation of a GFCI outlet. Typically, outlets are covered by a weather resistant covering to prevent the introduction of water, dirt or other undesired elements into the outlet. Receptacles contained in enclosed cavity region 78 may be covered individually or the entire outlet may be covered. In the alternative, such covering may comprise a surface to surround the outlet or an individual receptacle and a hinged door designed to swing to one side or another when lightpost 10 is installed. Such coverings may also have a door hinged above outlet 78 and can be useful to deflect water contacting cap 13 from contacting outlet 78 and entering one or both of the receptacles. Hinges as set forth herein may be typical multipart pin-based hinges or may be formed integral with the door and the surface of the covering surrounding the outlet or the individual receptacle.

In operation, at least one feed wire is positioned to extend from the ground surface proximate to where the landscape lightpost 10 is to be located. A cable connector is fastened into one or two apertures 61 or 62 in the housing separator 22 An end of the feed wire is fed through the cable connector allowing adequate cable for the installer to be able to splice the cable to the conductors of the fixture. The cable connector is then securely tightened around the feed wire with an end of the feed wire extending into the interior cavity 25 of the housing cap 20. Next, a light assembly 14 is attached to the housing cap 20 so that lamp connecting wires extend from light assembly 14 to the interior cavity 25 of the housing cap 20. The feed wire is then attached to lamp connecting wires using a desired mechanism such as a wire nut. This process is repeated for additional wires as necessary. The installer would then push the housing separator 22 into the housing base 21 by aligning the locking slots 69 with the housing separator flanges 53 of the housing base 21. The installer, after applying sufficient force to overcome the bayonet snap lock 70, rotates the separator 22 a quarter inch which radially moves the housing separator flanges 53 through the transition slot 72 and into the locked aperture 83.The feed wire is then attached to lamp connecting wires using a desired mechanism such as a twist-on wire connector. This process is repeated for additional wires as necessary. The installer would then push the housing separator 22 into the housing base 21 by aligning the locking slots 69 with the housing separator flanges 53 of the housing base 21. The installer, after applying sufficient force to overcome the bayonet snap lock 70, rotates the separator 22 a quarter inch which radially moves the housing separator flanges 53 through the transition slot 72 and into the locked aperture 83.

As an alternative to providing the landscape lightpost 10 as a complete unit, it is possible to provide the housing cap 13, housing base 21 and separator 22 for retrofitting landscape lightposts 12 that did not include a substantially enclosed region where wire connections are made. It will be appreciated that the costs and time associated with the project are substantially reduced by not having to replace the entire landscape lightpost. The landscape lightpost may be used for permanent installation of UF line voltage cable or conduit and makes installation quick, easy, and reliable.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A landscape lightpost apparatus for mounting an electric lamp, the apparatus suited to receive electrical and grounding feed wires from a region proximate the ground surface and route said wires into a locked region for electrical interconnection with at least one electrical device, the apparatus comprising:

a main post having a lower end, an upper end, and structure defining an internal bore for receiving electrical and grounding wires;

a housing base disposed about the upper end of the main post, said housing base defining an internal bore for receiving electrical and grounding wires, the internal bore including at least one engagement flange;

a housing separator disposed within the housing base, the housing separator including at least one locking slot, a separator plate, and a main post engagement ring for abutting engagement of the upper end of the main post, said locking slot positioned to receive the engagement flange of the housing base, and said separator plate defining at least one wire void for receiving electrical and grounding wires; and a cap having a cap body, receptacle cover, an open end and a substantially closed end, the cap body and substantially closed end defining an internal cavity having a longitudinal axis and an internal surface, the closed end of said cap including structure defining an aperture for holding an electric lamp fixture therein and said cap body including structure defining an aperture for holding an electrical device, said electrical device and said electric lamp fixture operably connected and in electrical communication with the electrical and grounding wires.

2. The landscape lightpost of claim 1 wherein the main post further includes a fin assembly disposed proximate the lower end, said fin assembly including at least one fin extending distally from the main post.

3. The landscape lightpost of claim 1 wherein the housing base includes a main post collar, a flared collar, and an interior guide ring, said flared collar providing a housing base transition area from the main post collar which encircles the upper end of the main post to the interior guide ring which is disposed within the housing cap, the flared collar further including a perpendicular lip for supporting the housing cap.

4. The landscape lightpost of claim 3 wherein the flared collar portion of the housing base further includes a lower lid engagement face that abuts an interior face of the receptacle cover.

5. The landscape lightpost of claim 3 wherein the interior guide ring includes a planar face that abuts an interior planar face of the housing cap.

6. The landscape lightpost of claim 1 wherein the separator plate has at least one knockout spaced from the aperture selectively removable to form an opening in the plate adapted to receive a cable connector.

7. The landscape lightpost of claim 1 wherein the locking slot of the housing separator includes an engagement aperture, a transition slot and a locking aperture, the engagement aperture disposed proximate a first end of the housing separator and extending axially along an outer face of the housing separator, the transition slot disposed intermediate the first end and a second end of the housing separator and said transition slot operably connecting the engagement aperture and the locking aperture, and said locking aperture radially offset from the engagement aperture.

8. The landscape lightpost of claim 7 wherein the locking aperture is radially offset from the engagement aperture by at least ⅛ of an inch.

9. The landscape lightpost of claim 7 wherein the locking aperture includes a bayonet snap lock for resisting the removal of the housing separator from the housing base once installed.

10. The landscape lightpost of claim 1 wherein the housing separator is formed of material selected from the group consisting of polyvinyl chloride and zinc die cast steel.

11. The landscape lightpost of claim 1 wherein the housing separator includes an arced flange that abuts a separator ledge of the housing base.

12. The landscape lightpost of claim 1 wherein the cap is formed of material selected from the group consisting of polyvinyl chloride and zinc die cast steel.

13. The landscape lightpost of claim 1 wherein the closed end of the cap has an arcuate external surface forming a crown to urge matter disposed on the external surface to move downwardly towards the ground surface urged by the force of gravity.

14. The landscape lightpost of claim 1 wherein the cap body has an external surface, a plurality of ribs arranged spaced apart from one another at regular pitch spacings on the external surface.

15. The landscape lightpost of claim 14 in which the cap body further includes a sealing groove disposed on a planar face of the external surface, said sealing groove defining a water tight area about the electrical receptacle aperture.

16. The landscape lightpost of claim 15 wherein the receptacle cover of the cap includes a sealing flange that mates with the sealing groove of the cap body.

17. The landscape lightpost of claim 1 wherein the aperture structure for holding an electric lamp at the closed end of said cap includes a plurality of ribs extending radially from the aperture.

18. A landscape lightpost apparatus for mounting an electric lamp fixture and an electrical receptacle having connecting wires, said apparatus adapted to receive and route electrical and grounding feed wires into an environmentally protected locked enclosure for making electrical connections with said lamp connecting wires and electrical receptacle connecting wires, said apparatus comprising:

a cap having a cavity defined by a first substantially closed end, a second open end and a cap body therebetween, said cap body further including a selectively opened aperture for mounting the electrical receptacle, the aperture covered by a housing cover;

means connected to said closed end of said cap for mounting said lamp fixture on said cap with said lamp connecting wires of said lamp fixture received in said cavity of said cap and means connected to said cap body for mounting said electrical receptacle on said cap body with said electrical receptacle connecting wires of said electrical receptacle received in said cavity of said cap;

means for sealing the housing cover to the cap body to protect the cavity from detrimental environmental conditions;

a housing base slidably received within said cavity of said cap for providing a conduit for receiving said feed wires routed through said post means and guiding them towards said lamp fixture, said cap including a lower abutment surface that rests on a perpendicular lip of the housing base, a housing separator slidably received within said conduit of said housing base for receiving and routing electrical and grounding feed wires from a region adjacent to the said ground surface through a main post to the cavity; and means for locking the housing separator to the housing base, said locking means including mating an engagement flange of the housing base with a locking slot of the housing separator, said locking slot including a bayonet type lock for maintaining relative position of the housing separator to the housing base in the locked position.

19. A landscape lightpost apparatus securable to a ground surface, said apparatus comprising:

an electric receptacle having receptacle connecting wires;

a main post having a lower end, an upper end, and structure defining an internal bore for receiving electrical and grounding feed wires from adjacent said ground surface;

a housing base disposed about the upper end of the main post, said housing base defining an internal bore for receiving electrical and grounding wires, the internal bore including at least one engagement flange, said housing base further defining a projecting lip with a diameter greater than that of the main post;

a housing separator disposed within the housing base, the housing separator including at least one locking slot, a separator plate, and a main post engagement ring for abutting engagement of the upper end of the main post, said locking slot positioned to receive the engagement flange of the housing base for sealing the main post internal bore from the housing base, and said separator plate defining at least one wire void for receiving electrical and grounding wires; and a cap having a cap body, receptacle cover, an open end and a substantially closed end, the cap body and substantially closed end defining an internal cavity having a longitudinal axis and an internal surface, the closed end of said cap including structure defining an aperture for holding an electric lamp fixture therein and said cap body including structure defining an aperture for holding the electrical receptacle, said electrical receptacle and said electric lamp fixture operably connected and in electrical communication with the electrical and grounding wires, the open end of the cap body forming an engagement face that mates with the projecting lip of the housing base.

20. The landscape lightpost of claim 19 wherein the separator plate has at least one knockout spaced from the wire void to form an opening in the plate adapted to receive a cable connector.

21. The landscape lightpost of claim 19 wherein the separator is formed of material selected from the group consisting of polyvinyl chloride and zinc die cast steel.

22. The landscape lightpost of claim 19 wherein the separator is formed of a metallic material and having a threaded hole spaced apart from the aperture.

23. The landscape lightpost of claim 19 wherein the cap is formed of material selected from the group consisting of polyvinyl chloride and zinc die cast steel.

24. The landscape lightpost of claim 19 wherein the cap is formed of a metallic material.

25. The landscape lightpost of claim 19 wherein the engagement flange is comprised of a plurality of longitudinal ribs arranged spaced apart from one another, disposed on and extending inwardly from the internal bore, said engagement flange having a radial length slightly smaller than the radial length of an engagement aperture of the locking slot so as to axially mate the housing base with the housing separator.

26. The landscape lightpost of claim 25 wherein the locking slot further includes a transition slot and a locked aperture, said transition slot disposed on a side wall of the engagement aperture, the transition slot providing a rotatable path from the engagement aperture to the locking aperture for the engagement flange.

27. The landscape lightpost of claim 19 wherein the locking slot further includes a bayonet lock.

28. The landscape lightpost of claim 19 wherein the cap has an external surface, a plurality of ribs arranged spaced apart from one another at regular pitch spacings on the surface.

29. The landscape lightpost of claim 19 wherein the internal cavity of the cap is offset from a vertical axis of the main post.

30. The landscape lightpost of claim 19 wherein the electrical receptacle mounts to an exterior face of the cap body, said exterior face surrounded by a sealing groove.

* * * * *

UNITED STATES PATENT AND TRADEMARK OFFICE

CERTIFICATE OF CORRECTION

PATENT NO. : 7,246,929 B2
APPLICATION NO. : 11/288556
DATED : July 24, 2007
INVENTOR(S) : Schuster It is certified that error appears in the above-identified patent and that said Letters Patent is hereby corrected as shown below:

Column 1, Line 13:
After "More" delete ".".

Column 1, Line 42:
After "Inc" insert --.--.

Column 4, Line 11:
Delete "case" and insert --cast--.

Column 5, Line 1:
After "12)" insert --.--.

Column 6, Line 3:
After "49" insert --,--.

Column 6, Line 31:
Delete "extend" and insert --extends--.

Column 7, Line 45:
After "depth" insert --of--.

Column 7, Line 56:
Delete "axially" and insert --axial--.

UNITED STATES PATENT AND TRADEMARK OFFICE

CERTIFICATE OF CORRECTION

PATENT NO. : 7,246,929 B2
APPLICATION NO. : 11/288556
DATED : July 24, 2007
INVENTOR(S) : Schuster It is certified that error appears in the above-identified patent and that said Letters Patent is hereby corrected as shown below:

Column 8, Line 28:
After "22" insert --.--.

Signed and Sealed this

Tenth Day of June, 2008

JON W. DUDAS
*Director of the United States Patent and Trademark Office*